US010288023B2

(12) United States Patent
Loiacono et al.

(10) Patent No.: US 10,288,023 B2
(45) Date of Patent: May 14, 2019

(54) PUMP UNIT FOR FEEDING FUEL, PREFERABLY DIESEL FUEL, TO AN INTERNAL COMBUSTION ENGINE

(71) Applicant: Robert Bosch GmbH, Stuttgart (DE)

(72) Inventors: Benedetto Loiacono, Modugno (IT); Domenico Macchia, Casamassima (IT); Luisa Moscarella, Bari (IT); Michele Antonio Iannuzzi, Bari (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/539,215

(22) PCT Filed: Nov. 25, 2015

(86) PCT No.: PCT/EP2015/077681
§ 371 (c)(1),
(2) Date: Jun. 23, 2017

(87) PCT Pub. No.: WO2016/102138
PCT Pub. Date: Jun. 30, 2016

(65) Prior Publication Data

US 2017/0356411 A1 Dec. 14, 2017

(30) Foreign Application Priority Data

Dec. 24, 2014 (IT) ..... MI2014A2255

(51) Int. Cl.
*F02M 59/10* (2006.01)
*F04B 1/04* (2006.01)
(Continued)

(52) U.S. Cl.
CPC ..... *F02M 59/102* (2013.01); *F02M 59/06* (2013.01); *F02M 59/464* (2013.01);
(Continued)

(58) Field of Classification Search
CPC .... F02M 59/102; F02M 59/06; F02M 59/464; F04B 1/0456; F04B 1/0421; F04B 1/0452; F04B 53/16; F04B 53/12
(Continued)

(56) References Cited

U.S. PATENT DOCUMENTS 302,978 A * 8/1884 Brislin ..... F04B 39/1073 417/571
1,944,858 A * 1/1934 Ottmar ..... F02M 59/02 123/501
(Continued)

FOREIGN PATENT DOCUMENTS

| | | |
|---|---|---|
| DE | 102012210107 | 12/2013 |
| WO | 2005090790 | 9/2005 |
| WO | 2015010856 | 1/2015 |

OTHER PUBLICATIONS

International Search Report for Application No. PCT/EP2015/077681 dated Jan. 15, 2016 (2 pages).

*Primary Examiner* — Lindsay Low
*Assistant Examiner* — John Bailey
(74) *Attorney, Agent, or Firm* — Michael Best & Friedrich LLP

(57) ABSTRACT

A pump unit for feeding fuel, preferably diesel fuel, to an internal combustion engine; the pump unit (1) comprising: a head (4) inside which a cylinder (12) extending along an axis (A1) is formed; a pumping piston (5) extending along the axis (A1) and slidingly coupled with the cylinder (12); a through-hole (13) which extends from the cylinder (12) towards the outside of the pump unit (1); an intake chamber (8) communicating with the cylinder (12) via the hole (13); an intake valve (7) which controls the flow of fuel from the intake chamber (8) to the hole (13); a cap (23; 123; 223) which is connected to the head (4), is arranged on the opposite side to the pumping piston (5) and can be selec-
(Continued)

tively fixed along an outer surface (25) of the head (4) so as to close the intake chamber (8) on one side.

16 Claims, 4 Drawing Sheets

(51) Int. Cl.
*F02M 59/46* (2006.01)
*F02M 59/06* (2006.01)
*F04B 53/12* (2006.01)
*F04B 53/16* (2006.01)

(52) U.S. Cl.
CPC ..... *F04B 1/0421* (2013.01); *F04B 1/0452* (2013.01); *F04B 1/0456* (2013.01); *F04B 53/12* (2013.01); *F04B 53/16* (2013.01)

(58) Field of Classification Search
USPC ..... 123/445, 508, 500–502; 417/421, 422, 417/60, 256, 257, 260, 444, 459, 545, 417/546–555.1, 562; 74/567, 838; 91/491, 498, 6.5; 92/129, 74, 73, 55
See application file for complete search history.

(56) References Cited

U.S. PATENT DOCUMENTS 2,022,653 A * 12/1935 Chandler ..... F02M 41/06 123/505
3,043,321 A * 7/1962 Hewitt ..... F16K 17/36 123/198 DC
3,100,449 A * 8/1963 Dahl ..... F02M 41/123 137/565.28
4,100,902 A * 7/1978 Kosuda ..... F02M 59/205 123/450
4,412,519 A * 11/1983 Hoch ..... F02M 41/10 123/449
4,573,444 A * 3/1986 Howes ..... F02D 1/183 123/179.17
4,976,236 A * 12/1990 Brunel ..... F02M 41/06 123/300
5,033,443 A * 7/1991 Kato ..... F02M 41/126 123/300
5,050,558 A * 9/1991 Brunel ..... F02M 41/06 123/450
5,092,299 A * 3/1992 Muntean ..... F02D 7/007 123/381
5,441,029 A * 8/1995 Hlousek ..... F02M 47/027 123/446
5,755,562 A * 5/1998 Novacek ..... F02M 59/04 417/269
5,836,749 A * 11/1998 Novacek ..... F04B 1/124 417/269
6,224,350 B1 * 5/2001 Guentert ..... F02M 63/0225 137/454.4
6,289,875 B1 * 9/2001 Shinohara ..... F02M 39/005 123/450
6,345,609 B1 * 2/2002 Djordjevic ..... F02M 59/06 123/456
6,568,927 B1 * 5/2003 Guentert ..... F02M 37/043 123/446
6,659,734 B1 * 12/2003 Hervault ..... F02M 37/12 417/269
6,698,399 B1 * 3/2004 Grabert ..... F04B 1/0421 123/456
7,296,980 B2 * 11/2007 Olivieri ..... F02M 59/06 417/273
8,545,192 B2 * 10/2013 Tsuboi ..... F02M 59/06 29/888.02
8,794,939 B2 * 8/2014 Cheron ..... F02M 59/485 137/541
2001/0005485 A1 * 6/2001 Mori ..... F04B 1/0421 417/569
2002/0192092 A1 * 12/2002 Mori ..... F04B 1/0452 417/471
2005/0079082 A1 * 4/2005 Olivieri ..... F02M 59/06 417/571
2007/0215113 A1 * 9/2007 Dutt ..... F02M 59/485 123/445
2011/0142689 A1 * 6/2011 Tsuboi ..... F02M 59/06 417/273
2014/0346258 A1 * 11/2014 Stucchi ..... F16K 31/008 239/583
2016/0208794 A1 * 7/2016 Singh ..... F04B 51/00

* cited by examiner

PUMP UNIT FOR FEEDING FUEL, PREFERABLY DIESEL FUEL, TO AN INTERNAL COMBUSTION ENGINE

BACKGROUND OF THE INVENTION

The present invention relates to a pump unit for feeding fuel, preferably diesel fuel, to an internal combustion engine.

In general, a pump unit comprises a pump body; a head assembled on the pump body; a pumping piston housed inside the head; a cylinder which houses the pumping piston; an intake valve having a valve body housed inside a seat formed in the head; and a delivery valve.

The valve body is fixed to the seat by means of threaded means which mate with the inner walls of the seat. In particular, the pump body comprises a connector which has a threaded, outer, side surface and is housed inside the seat after the valve body has been inserted. The connector keeps the valve body in contact with the head. The connector is fixed to the inner side surface of the seat by means of a threaded connection provided with a threaded surface formed on the threaded, outer, side wall of the connector and another threaded surface formed on the inner side wall of the seat.

One of the main drawbacks of the prior art consists in the fact that, in order to form the threaded surface on the inner side wall of the seat, fairly long and costly precision-machining operations are necessary. Moreover, the said threaded surfaces thus formed may give rise to wear and problems of leak-tightness during the working life of the pump because the forces which they must be withstand are high.

SUMMARY OF THE INVENTION

One object of the present invention is that of providing a pump unit of the type described above which limits the abovementioned drawbacks.

According to the present invention a pump unit for feeding fuel, preferably diesel fuel, to an internal combustion engine is provided; the pump unit comprising:

a head inside which a cylinder extending along an axis is formed;

a pumping piston extending along the axis and slidingly coupled with the cylinder;

a through-hole which extends from the cylinder towards the outside of the pump unit;

an intake chamber communicating with the cylinder via the hole;

an intake valve which controls the flow of fuel from the intake chamber to the hole;

a cap which is connected to the head, is arranged on the opposite side to the pumping piston and can be selectively fixed along an outer surface of the head so as to close the intake chamber on one side.

As a result of the present invention, closure of the head by means of the cap is performed in an efficient and low-cost manner. Owing to fixing along an outer surface of the head, the threaded connection is simpler to realize and less costly. Moreover, fixing along the outer surface of the head results in less wear and a more efficient sealing action. Moreover, the threaded inner surface of the cap may be easily realized. In other words, as a result of the present invention, the threaded connection is provided partly along an inner surface of the cap which ensures an optimum seal, low costs and shorter manufacturing times.

According to a preferred embodiment of the present invention, the head and the cap define the intake chamber into which an intake duct leads.

As a result of the present invention, the intake chamber is located between the head and the cap and has lower manufacturing costs and shorter manufacturing times.

According to another preferred embodiment of the present invention, the outer surface of the head is threaded so that it may be connected to the cap.

Owing to the thread on the outer surface of the head an excellent sealing action and low manufacturing cost are ensured.

According to another preferred embodiment of the present invention, the cap comprises a threaded inner surface which mates with the outer surface of the head.

The threaded inner surface formed on the cap is easy and inexpensive to produce.

According to another preferred embodiment of the present invention, the intake valve comprises a valve body formed inside the head, and a closing member arranged inside the hole; preferably the valve body and the cylinder are formed as a single monobloc.

As a result of the present invention, the friction and wear points inside the pump unit are reduced and the working life of the pump unit increases and the leak-tightness is improved.

According to another embodiment of the present invention, the pump unit comprises a compression chamber formed in the cylinder and communicating with the hole so as to receive fuel through the hole. Moreover, the intake valve comprises a closing member, a resilient element and disc element fixed integrally to the closing member; and wherein the resilient element is arranged between the head and the disc element so as to control the movement of the closing member.

According to another embodiment of the present invention, the cap comprises a cavity inside which the disc element slides so as to dampen the movement of the closing member and wherein a diameter of the cavity has a dimension which is at the most equal to the product of 1.4 times a diameter of the disc element.

As a result of the present invention the wear between the contact point of the closing member and the head is reduced.

According to another embodiment of the present invention, the cap comprises a cover-piece for closing the intake chamber on one side and a ring nut for locking the cover-piece in a given position.

According to another embodiment of the present invention, the cover-piece comprises a collar which protrudes radially with respect to the axis outwards; the ring nut comprises a flange which protrudes radially with respect to the axis inwards and engages with the collar of the cover-piece.

As a result of the present invention, the connection between the cap and the head ensures an optimum seal.

According to another preferred embodiment of the present invention, the collar comprises a first projecting surface; and the ring nut comprises a second projecting surface which makes contact with the first projecting surface.

According to another preferred embodiment of the present invention, the ring nut exerts an axial force on the cover-piece so as to keep the cover-piece in contact with the head.

According to another preferred embodiment of the present invention, the cap is a single piece and comprises a central portion for delimiting on one side the intake chamber and a side portion for engagement with the head.

According to another preferred embodiment of the present invention, the pump unit comprises a sealing element arranged between the cap and the head.

As a result of the present invention the pump unit is low-cost and easy to implement.

According to another preferred embodiment of the present invention, the intake valve is of the mechanical type; preferably the intake valve is operated during opening and closing by the difference in pressure between the cylinder and a compression chamber arranged inside the cylinder.

BRIEF DESCRIPTION OF THE DRAWINGS

The invention will now be described with reference to the accompanying drawings which illustrate a non-limiting example of embodiment thereof, in which.

DETAILED DESCRIPTION

Figure 1:
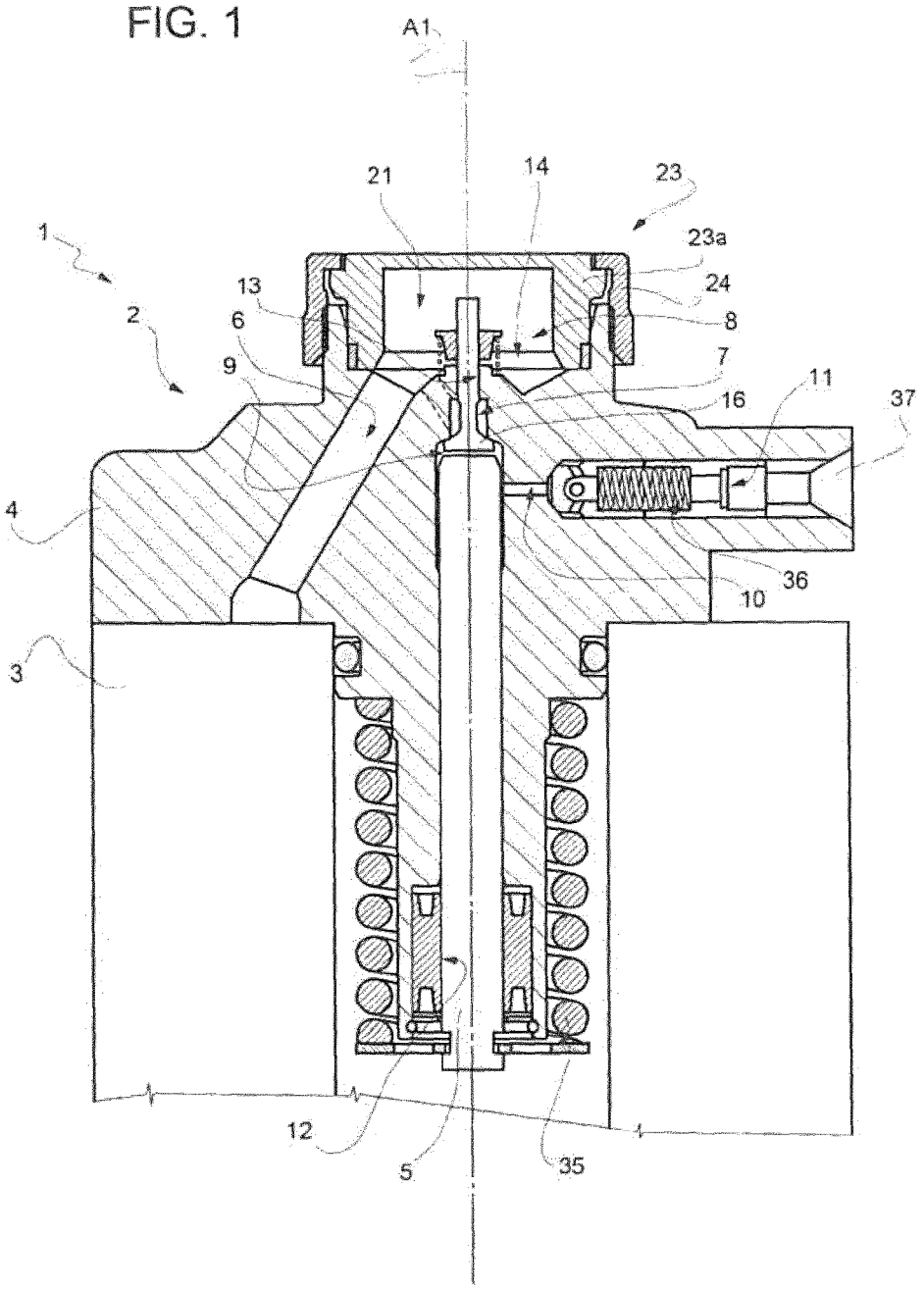
FIG. 1 is a cross-sectional view, with parts removed for greater clarity, of the pump unit designed in accordance with an embodiment of the present invention.
Figure 2:
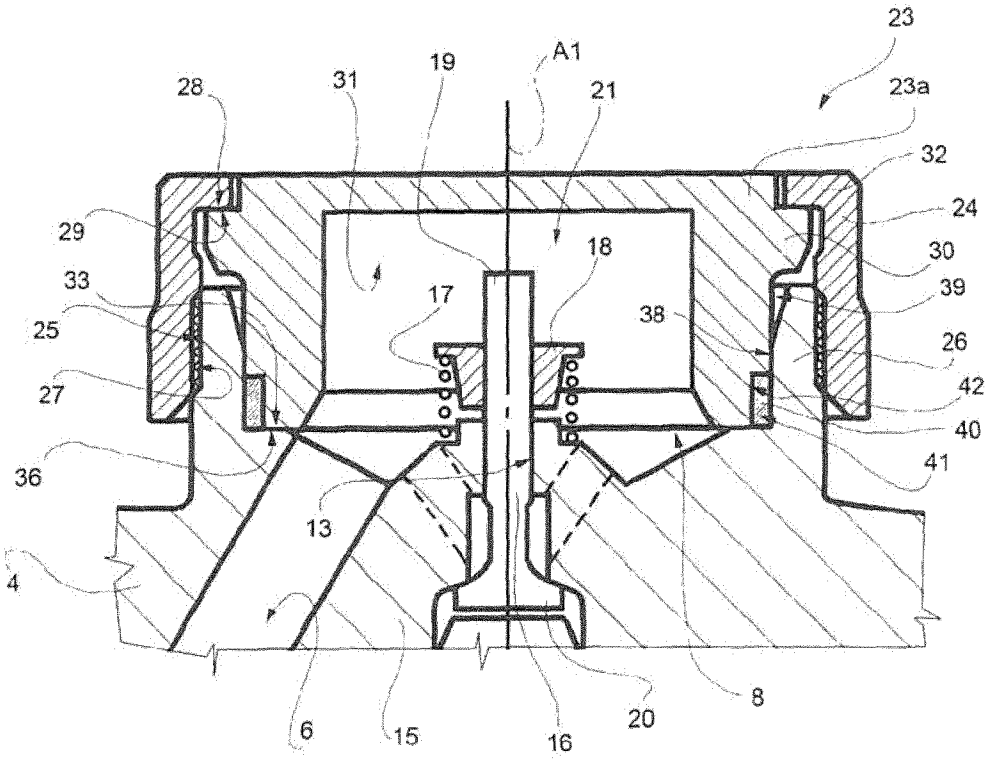
FIG. 2 is a view, on larger scale, of a detail of FIG. 1.

With reference to FIGS. 1 and 2, 1 denotes in its entirety, a pump unit for feeding fuel, preferably diesel fuel, to an internal combustion engine (not shown).

The pump unit 1 comprises a high-pressure pump 2 of the pumping piston type designed to feed the fuel to the said internal combustion engine (not shown); and a known gear pump (not shown) designed to feed the fuel to the pump 2. The pump 2 and the gear pump are driven by a shaft (not shown in the attached figures).

The pump 2 comprises a pump body 3; a head 4 assembled on the pump body 2; a cylinder 12 formed in the head 4 and extending along an axis A1; a pumping piston 5 which extends along the axis A1 and is slidingly coupled with the cylinder 12; an intake duct 6 formed partly in the head 4; an intake valve 7 communicating with the intake duct 6; an intake chamber 8 arranged between the intake duct 6 and the intake valve 7; a compression chamber 9 communicating with the intake chamber 8 via the intake valve 7; a delivery duct 10 formed partly inside the head 4 and communicating with the compression chamber 9; and a delivery valve 11 for selectively interrupting the fuel along the delivery duct 10.

The head 4 has a through-hole 13 which is formed in the head 4 coaxially with the axis A1 and communicates with one end of the cylinder 12. In particular, the hole 13 extends from the cylinder 12 towards the outside of the head 4. In greater detail, the hole 13 extends inside the head 4 from the intake chamber 8 to the compression chamber 9 and houses part of the intake valve 7. The head 4 comprises a seat 14 which houses the intake chamber 8. The seat 14 and the cylinder 12 are arranged on opposite sides of the hole 13.

The pumping piston 5 is displaced by an actuating device (not shown in the attached figures) along the cylinder 12 with an alternating rectilinear movement comprising an intake stroke for drawing the fuel inside the cylinder 12 and a compression stroke for the fuel contained inside the said cylinder 12, i.e. for compressing the fuel drawn into the compression chamber 9.

The intake duct 6 connects the gear pump to the intake valve 7.

The intake valve 7 is of the mechanical type. The intake valve 7 is designed to control selectively feeding of the fuel inside the cylinder 12 from the intake chamber 8 to the compression chamber 9 along the hole 13. The intake valve 7 extends along the axis A1 and comprises a valve body 15 which is formed inside the head 4. In other words, a portion of the head 4 defines the valve body 15 of the intake valve 7, another portion of the head 4 defines also the cylinder 12. Therefore, the valve body 15 and the head 4 are formed as a single monobloc, preferably by means of machining with stock removal.

With reference to FIG. 2, the intake valve 7 comprises a closing member 16 movable along the axis A1 so as to allow selectively the fuel to pass through; a resilient element 17; and a disc element 18 fixed integrally to the closing member 16. The closing member 16 comprises a stem 19 and a foot 20. The stem 19 is housed inside the hole 13. The foot 20, when in use during the compression phase, makes contact with the valve body 15 in particular with one end of the cylinder 12 into which the hole 13 leads. The disc element 18 is fixed to the stem 19 of the closing member 16 and the resilient element 17 is arranged between the valve body 15 and the disc element 18. In other words, the resilient element 17 is arranged between the head 4 and the disc element 18. In particular, the resilient element 17 imparts a resilient force which opposes opening of the closing member 16 when the pump unit 1 is in the intake phase. In fact, during the intake phase, the pressure inside the compression chamber 9 is less than the pressure inside the intake duct 6 and the closing member 16 is pushed by the difference in pressure along the axis A1 towards the pumping piston 5. In this way the closing member 16 allows the fuel to pass from the intake chamber 8 to the compression chamber 9. Consequently, the intake valve 7 is of the mechanical type because it operates by means of pressure difference without the aid of an electronic control mechanism acting directly on the closing member 16.

During the compression phase, the pumping piston 5 moves along the axis A1 towards the closing member 16. The intake valve 7 during the compression phase is in the closed position and the closing member 16 is in contact with the head 5. In fact, when the intake phase finishes, the resilient element 17 pushes the closing member 16 along the axis A1 from the opposite side to the pumping piston 5. In this case, the foot 20 of the closing member 16 makes contact with the valve body 15 which is defined by the portion of the head 5. During the compression phase, the resilient element 17 keeps the foot 20 of the closing member 16 in contact by applying a force along the axis A1 to the stem 19 of the closing member 16 via the disc element 18. In other words, the resilient element 17 pushes the disc element 18 along the axis A1 in a direction opposite to the cylinder 12.

The head 4 defines a seat 21 which houses the intake chamber 8 and into which the intake duct 6 at least partly formed in the head 4 leads.

With reference to FIGS. 1 and 2, the head 4 comprises a cap 23 connected to the head 4 and arranged on the opposite to the pumping piston 5 relative to the hole 13. The cap 23 comprises a cover-piece 23*a* and a ring nut 24 which fixes the cover-piece 23*a* to the head 4. The ring nut 24 is connected along an outer surface 25 of the head 4. The head 4 comprises an annular wall 26 of the seat 21. The outer surface 25 is annular and is defined by the outer surface of the wall 26 of the seat 21. In particular, the wall 26 is defined by a cylinder portion and the outer surface 25 is the outer surface of the cylinder portion. The cap 23 delimits the seat 21, closing it sealingly on one side. Moreover, the outer surface 25 is threaded so as to engage with the ring nut 24 of the cap 23. The ring nut 24 engages with the cap 23*a* and the head 4. In particular, the ring nut 24 comprises a threaded inner surface 27 which mates with the outer surface 25 of the head 4. The cover-piece 23*a* comprises a collar 30 which extends radially with respect to the axis A1 outwards and which comprises a projecting surface 28 which during use faces the ring nut 24. The ring nut 24 comprises a flange 32 which extends radially with respect to the axis A1 inwards and which comprises a projecting surface 29 which during use faces the head 4. During use, the flange 32 engages with the collar 30 of the cover-piece 23*a*. Moreover, the projecting surface 29 makes contact with the projecting surface 28. In other words, the ring nut 24 exerts an axial force on the cover-piece 23*a* so as to keep the cover-piece 23*a* in contact with the head 4 along an annular contact surface 33 of the head 4 and an annular contact surface 36 of the cover-piece 23*a*. The annular contact surface 33 of the head 4 is situated outside the intake chamber 8. In greater detail the contact surfaces 33 and 36 are situated inside the seat 21 and are arranged between the inner surface 38 of the annular wall 26.

The cap 23 delimits on one side the intake chamber 8. In greater detail the cap 23*a* has a cavity 31 which defines part of the intake chamber 8. The cover-piece 23*a* also houses part of the closing member 16, in particular the disc element 18 and part of the stem 19 inside the cavity 31. The cover-piece 23*a* defines part of the intake chamber 8.

Moreover, the pump unit 1 comprises a sealing ring 40 arranged inside a cavity 41 arranged between the cover-piece 23*a* and the head 4. In particular, the cover-piece 23*a* has an annular recess 42 which extends radially with respect to the axis A1 along an outer side surface 39 and in the vicinity of the contact surface 36. The cavity 41 is defined between the annular recess 42 and the head 4, in particular between the annular recess 42 and the wall 26 of the seat 21, in particular along a portion of the inner surface 38 of the wall 26.

The sealing ring 40 may be made of rubber, plastic or metallic material. The sealing ring 40 is made of a material having a hardness which is less than the hardness of the material of the cover-piece 23*a* and the head 4. The sealing ring 40 is configured to prevent liquid from escaping from the intake chamber 8 towards the outside of the head 4.

With reference to FIG. 1, the pump unit 1 comprises a resilient element 35; in the non-limiting embodiment shown in the attached figures it is a helical spring engaged between a free end 36 of the pumping piston 7 and the head 4.

The pump unit 1 comprises a seat 36 for the delivery valve 11 and a connector 37 for keeping the delivery valve 11 inside the seat 36. The delivery valve 11 is housed along the delivery duct 10 and is designed to control selectively feeding of the fuel to the said internal combustion engine (not shown).

Figure 3:
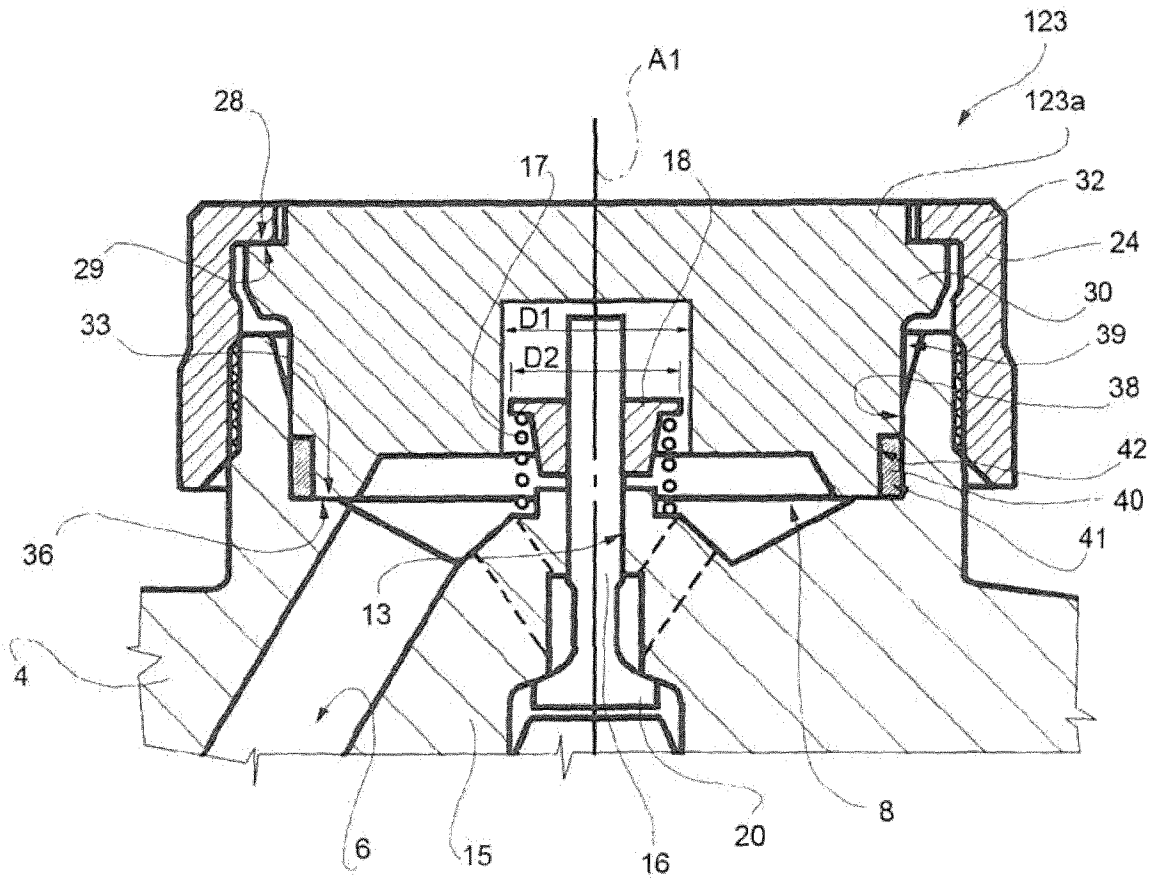
FIG. 3 is a view, on a larger scale, of a detail of an embodiment which is alternative to the embodiment shown in FIG. 1.

According to an alternative embodiment shown in FIG. 3, the pump unit 1 comprises the cap 123 instead of the cap 23. The cap 123 comprises the cover-piece 123*a* instead of the cover-piece 23*a*. The cover-piece 123*a* differs from the cover-piece 23*a* owing to the internal shape of the cavity. The cover-piece 123*a* has a cavity 131 with a cylindrical cross-section having a shape the same as the shape of the disc element 18. The cavity 131 has a cylindrical shape like the disc element 18, in particular the cavity 131 has a cylindrical shape with a circular base. The cavity 131 houses the disc element 18 inside the cylindrical portion and so that the disc element 18 is free to move along the axis A1. In greater detail, the cylindrical portion of the cavity 131 has a diameter D1 comparable to a diameter D2 of the disc element 18 so as to produce a damping effect when the disc element 18 moves inside the cavity 131. In greater detail, when the disc element 18 moves inside the cavity 131 it propels the fuel which occupies the cavity 131. The fuel under the pressure of the disc element 18 tends to move into a zone of the cavity 131 where there is less pressure. In greater detail, when the disc element 18 moves towards the cover-piece 123*a*, the fuel tends to move from the cavity 131 towards the head 4. As a result, the movement of the disc element 18 is slowed down by the fuel. The diameter D1 of the cavity 131 has a value which is at the most 40% greater than the diameter D2 of the disc element 18. Owing to the cavity 131, the movement of the closing member 16 is dampened and this causes less wear at the point where the foot 20 makes contact with the valve body 15 which in this case is formed directly on the head 4.

Figure 4:
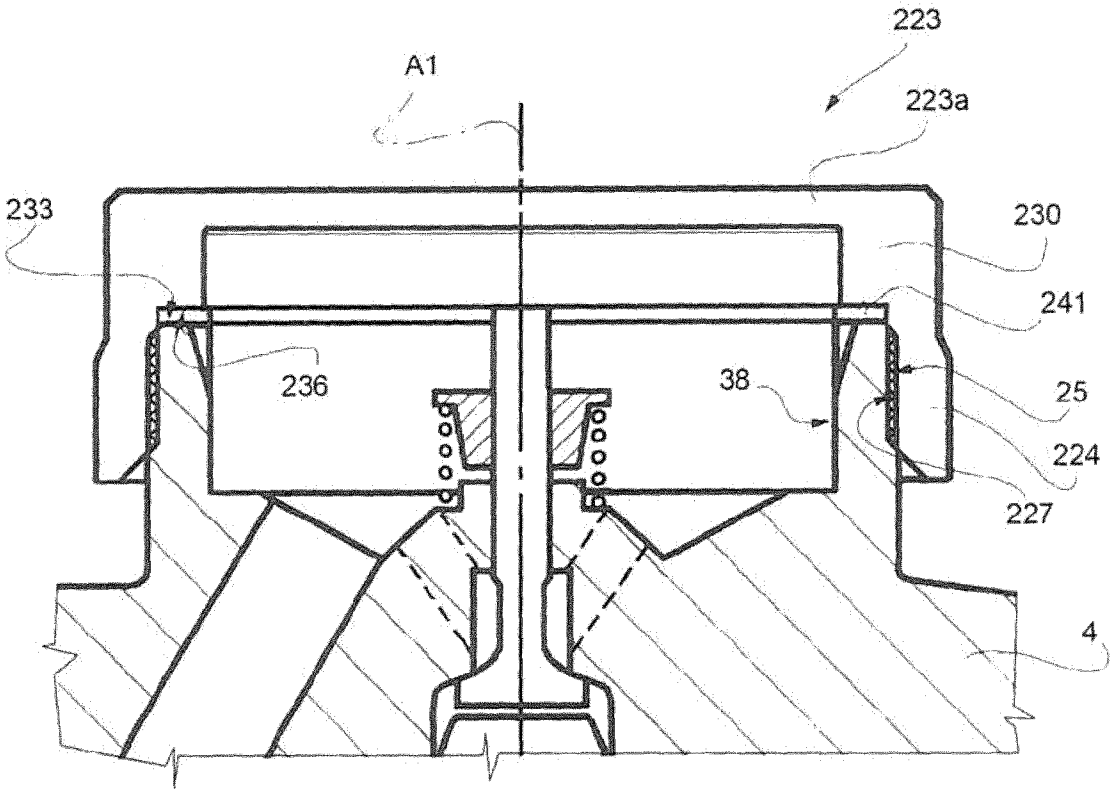
FIG. 4 is a view, on a larger scale, of a detail of an another embodiment which is alternative to the embodiment shown in FIG. 1.

According to another alternative embodiment shown in FIG. 4, the pump unit 1 comprises the cap 223 instead of the cap 23. The cap 223 is composed of a single piece and comprises a central portion 223*a* and a side portion 224. The central portion 223*a* extends radially with respect to the axis A1 and delimits on one side the intake chamber 8. The side portion 224 extends along the axis A1. The side portion 224 mates with the head 4, in particular with the wall 26 along the threaded outer surface 25 of the head 4. In particular, the side portion 224 has a threaded inner surface 227 for engagement with the head 4. The cap 223 closes the intake chamber 8 on one side.

The pump unit 1 comprises a sealing element 241 arranged between the cap 223 and the head 4. In particular, the head 4 comprises a contact surface 233 arranged at one end of the seat 21 of the head 4, in particular between the threaded side surface 25 and the inner side surface 38 of the seat 21 of the head 4. In other words, the contact surface 233 is arranged along a base of the cylindrical portion of the seat 21. The cap 223 comprises a contact surface 236 which during use faces the contact surface 233 and is defined by an inner radial shoulder 230 arranged along the side portion 224. The sealing element 241 is arranged between the contact surface 236 and the contact surface 233. The sealing element 241 is rigid and may be made of plastic or metallic material. The sealing element 241 has a hardness factor less than that of the cap 223 and the head 4.

It is moreover evident that the present invention also covers embodiments not described in the detailed description and equivalent embodiments which fall within the scope of protection of the attached claims.

The invention claimed is:

1. A pump unit for feeding fuel to an internal combustion engine; the pump unit comprising:

a head defining a cylinder extending along an axis;

a pumping piston extending along the axis and sliding within the cylinder;

a through-hole which extends from the cylinder towards an outside of the pump unit;

an intake chamber communicating with the cylinder via the through-hole;

an intake valve which controls flow of fuel from the intake chamber to the through-hole; and a cap which is connected to the head, is arranged on an opposite side to the pumping piston and is configured to be selectively fixed along an outer surface of the head so as to close the intake chamber on one side;

the head having an annular wall defined by a cylinder portion, the outer surface being defined by the outer surface of the cylinder portion;

the cap comprising a cover-piece for closing the intake chamber on one side and a ring nut for locking the cover-piece in a given position;

the cover-piece having an annular contact surface in contact with an annular contact surface of the head, the contact surface of the cover-piece and the contact surface of the head being arranged inside the inner surface of the annular wall;

wherein a sealing element is arranged between the cover-piece and the inner surface of the annular wall of the head.

2. The pump unit according to claim 1, characterized in that the head and the cap define the intake chamber into which an intake duct leads.

3. The pump unit according to claim 1, characterized in that the outer surface of the head is threaded so that the head may be connected to the cap.

4. The pump unit according to claim 3, characterized in that the cap comprises a threaded inner surface which mates with the outer surface of the head.

5. The pump unit according to claim 1, characterized in that the intake valve comprises a valve body formed by a portion of the head, and a closing member arranged inside the through-hole.

6. The pump unit according to claim 1, comprising a compression chamber formed in the cylinder and communicating with the through-hole so as to receive fuel through the through-hole.

7. The pump unit according to claim 1, characterized in that the intake valve comprises a closing member, a resilient element and a disc element fixed integrally to the closing member; wherein the resilient element is arranged between the head and the disc element so as to control movement of the closing member.

8. The pump unit according to claim 7, characterized in that the cap comprises a cavity inside which the disc element slides so as to dampen the movement of the closing member, wherein a diameter of the cavity has a dimension which is at the most equal to the product of 1.4 times a diameter of the disc element.

9. The pump unit according to claim 1, characterized in that the cover-piece comprises a collar which protrudes radially with respect to the axis outwards, wherein the ring nut comprises a flange which protrudes radially with respect to the axis inwards and engages with the collar of the cover-piece.

10. The pump unit according to claim 9, characterized in that the collar comprises a first projecting surface and the ring nut comprises a second projecting surface which makes contact with the first projecting surface.

11. The pump unit according to claim 1, characterized in that the ring nut exerts an axial force on the cover-piece so as to keep the cover-piece in contact with the head.

12. The pump unit according to claim 1, characterized in that the intake valve is of a mechanical type.

13. The pump unit according to claim 1, characterized in that the intake valve comprises a valve body formed by a portion of the head, and a closing member arranged inside the through-hole, wherein the valve body and the head are formed as a single monobloc.

14. The pump unit according to claim 1, characterized in that the intake valve is of a mechanical type, wherein the intake valve is operated during opening and closing by a difference in pressure between the cylinder and a compression chamber arranged inside the cylinder.

15. The pump unit according to claim 1, wherein the annular contact surface of the cover-piece and the annular contact surface of the head are perpendicular to the axis, and wherein the sealing element is also arranged between the cover-piece and the annular contact surface of the head.

16. The pump unit according to claim 15, wherein the cover-piece has an annular recess which extends radially inward from an outer side surface of the cover-piece and axially from the annular contact surface of the cover-piece, and wherein the sealing ring is arranged in the recess.

* * * * *